US006343764B1

(12) United States Patent
Hayashi et al.

(10) Patent No.: US 6,343,764 B1
(45) Date of Patent: Feb. 5, 2002

(54) METHOD OF PREVENTING LOOSENING OF WIRE WOUND AROUND A REEL FOR FASTENING REINFORCING BARS

(75) Inventors: Susumu Hayashi; Syuichi Ishii; Osamu Itagaki; Ichiro Kusakari, all of Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/457,266

(22) Filed: Dec. 9, 1999

(30) Foreign Application Priority Data

Dec. 10, 1998 (JP) ..... 10-350907

(51) Int. Cl.[7] ..... B65H 54/10; B65H 51/015; B21F 3/00

(52) U.S. Cl. ..... 242/475.7; 242/172; 242/910; 140/92.2

(58) Field of Search ..... 242/475.7, 172, 242/910, FOR 110; 140/92.2

(56) References Cited

U.S. PATENT DOCUMENTS

| | | | | | |
|---|---|---|---|---|---|
| 2,265,246 | A | | 12/1941 | Ott | 242/78 |
| 3,231,217 | A | | 1/1966 | Justice, Jr. | 242/159 |
| 3,313,498 | A | | 4/1967 | Wasson | 242/96 |
| 3,315,592 | A | * | 4/1967 | Lems | 242/910 X |
| 3,329,083 | A | * | 7/1967 | Bellmann | 242/910 X |
| 3,417,688 | A | * | 12/1968 | Shakely | 242/910 X |
| 3,503,565 | A | | 3/1970 | Durkee et al. | 242/25 |
| 4,067,441 | A | * | 1/1978 | Newman et al. | 242/172 X |
| 5,425,509 | A | * | 6/1995 | Van Severen et al. | 242/475.7 X |
| 5,494,160 | A | * | 2/1996 | Gelmetti | 242/172 X |
| 6,019,141 | A | * | 2/2000 | Barrera | 140/92.2 |

* cited by examiner

*Primary Examiner*—Donald P. Walsh
*Assistant Examiner*—Minh-Chau Pham
(74) *Attorney, Agent, or Firm*—Morgan, Lewis & Bockius LLP

(57) ABSTRACT

A method of preventing loosening of a wire wound around a reel for fastening reinforcing bars. The method comprises pressurizing an outer circumferential surface of the wire inwardly in the radius directions of the reel so that elastic forces in the directions which the outer diameter of the wire is increased are deprived therefrom, and the condition of wound wire is maintained after the pressure is released.

4 Claims, 4 Drawing Sheets

METHOD OF PREVENTING LOOSENING OF WIRE WOUND AROUND A REEL FOR FASTENING REINFORCING BARS

BACKGROUND OF THE INVENTION

1. Field of the Invention

The present invention relates to a method of preventing a wire for fastening reinforcing bars from being loosened. More particularly, the present invention relates to a method of processing a preventive treatment for a wire for fastening reinforcing bars so that the wire is prevented from being loosened after the wire is wound around a reel.

2. Description of the Related Art

Recently, a reinforcing bar fastening machine is widely employed for binding reinforcing bars at construction works with reinforced concrete instead of conventional handwork. A reinforcing bar fastening machine uses batteries as power source for driving, and fastens reinforcing bars by feeding a wire which is wound around a reel. When a trigger lever is operated with hooking a nose portion which is arcuately curved in shape to the reinforcing bars, the wire is fed along an inner circumferential surface of the nose portion and wound around the reinforcing bars. Then the fed part of the wire is cut with a cutter disposed at a tip portion of the nose portion, and the reinforcing bars are fastened so that a hook claw grasps and twists the wound wire.

A wire, made of soft iron, are provided in a form wound around a reel. Before using the wire, the reel is installed to the reinforcing bar fastening machine, and the piece of tape on the wire is peeled off. Then the tip portion of the wire is inserted to a wire feed mechanism of the reinforcing bar fastening machine, and the reinforcing bar fastening machine is prepared for use. However, when the piece of tape on the wire is peeled off, winding of the wire are loosened and swelled by elastic restitutive force. This is called as a "spring-back" phenomenon, and this phenomenon makes it difficult to find the tip portion of the wire because the tip portion is buried in a plurality of coil turns, of which winding diameters are increased. In addition, if the tip portion of the wire is passed under another turn by mistake, the wire is tied so that it is difficult to handle. Moreover, if fastening are operated in condition that winding of the wire are loosened, it is possible that the wire accidentally comes off the reel and twines around itself.

SUMMARY OF THE INVENTION

Accordingly, there is a technical problem how to prevent winding of the wire from being loosened in order to ease the handling and to prevent twining of the wire. Therefore, it is the object of the present invention to solve the above problem.

The present invention is proposed to attain the above object, and the present invention provides a method that the outer circumferential surface of the wire wound around the reel is processed with pressurizing it inwardly in the radius directions of the reel in order to deprive elastic forces in the directions which the outer diameter of the wire is increased so that a wire wound around a reel for fastening reinforcing bars is prevented from being loosened, and the condition of the wound wire is maintained after the pressure is released.

It is preferable that pressurizing the outer circumferential surface of the wire forms at least one angled portion on the outer circumferential surface of the wire.

DETAILED DESCRIPTION OF THE PREFERRED EMBODIMENT

Figure 1A:
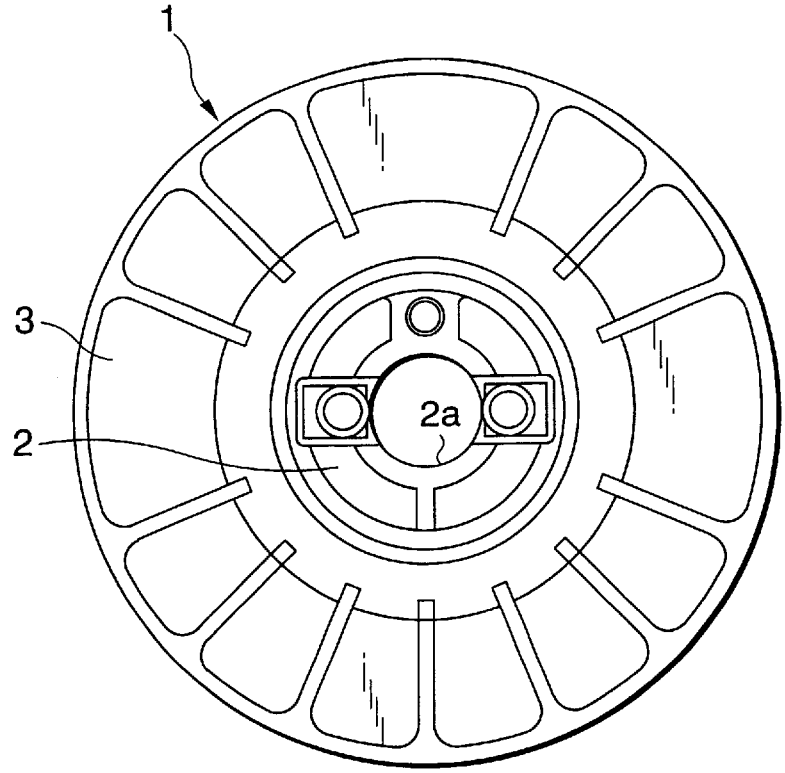
FIG. 1A is a side view of a reel-wound wire for fastening reinforcing bars.

Hereinafter, embodiments of the present invention will be described in detail with reference to the attached drawings. In FIG. 1, the numeral 1 designates a reel, and the reel 1 is intergrally formed with a hub 2 and a flange 3. Into a center hole 2*a* of the hub 2, a real support shaft of a reinforcing bar fastening machine (not shown) is inserted, and the reel 1 is rotatably supported. In order to wind a wire W around the reel 1, the reel 1 is installed to a wire winding machine, and the wire W is wound at a predetermined winding torque.

Figure 1B:
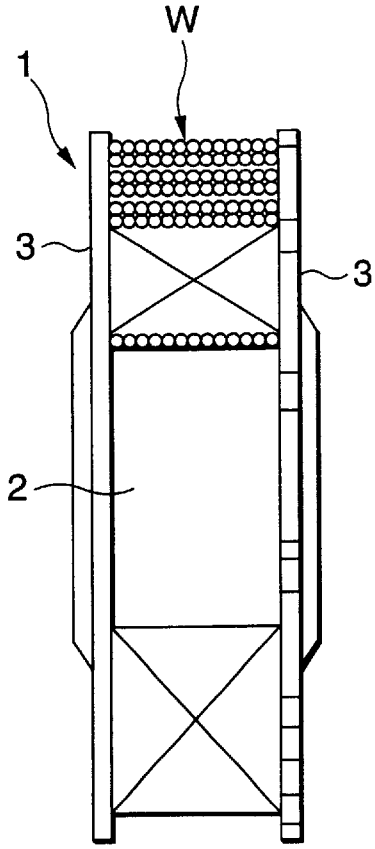
FIG. 1B is a front view of a reel-wound wire for fastening reinforcing bars.
Figure 2:
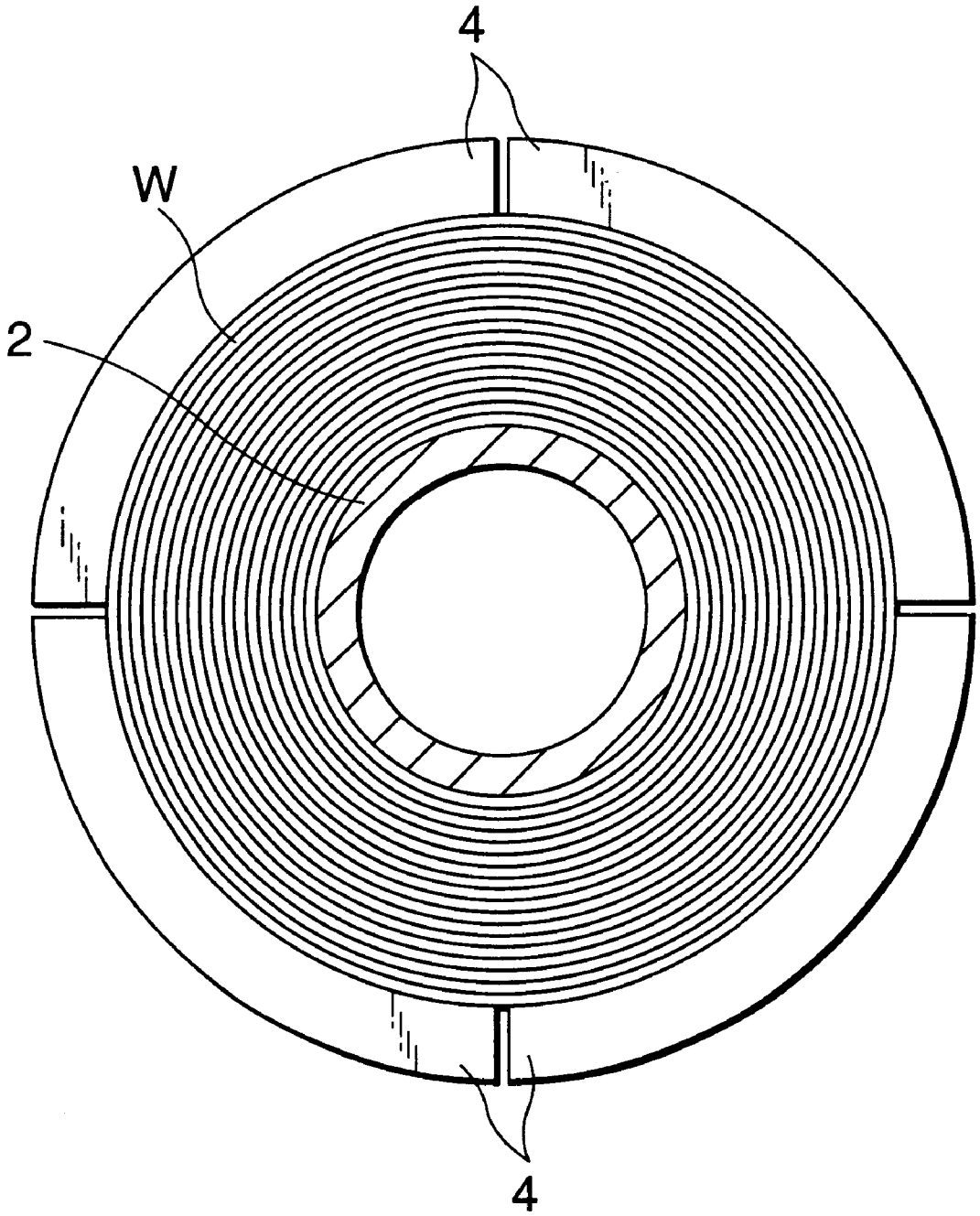
FIG. 2 is a explanatory drawing which describes a process to prevent loosening with chucks.
Figure 3:
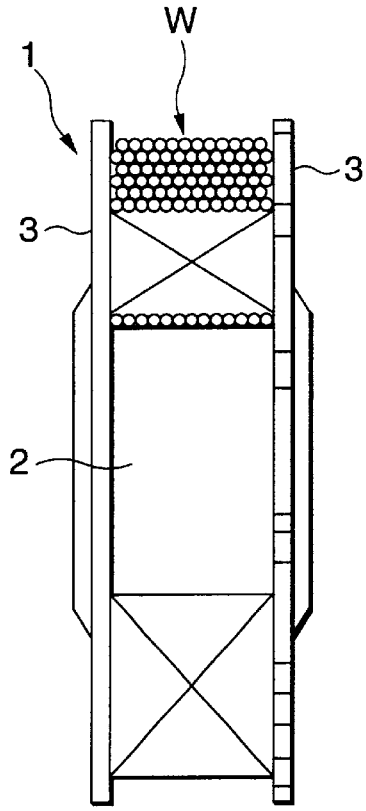
FIG. 3 is a front sectional view of a wire wound around a reel after processing a treatment to prevent loosening.

As shown in FIG. 1B, the wire W is spirally wound with making multi-layer spiral winding. If a tip portion of the wire W is not fixed with a tape or the like, the wire W is swelled because elastic restitutive force loosens the winding. Now, as shown in FIG. 2, the outer circumference of the wire W is pressurized inwardly in the radius direction with a chuck 4 of chuck-tape presseurizing machine. As shown in FIG. 3, this pressurizing changes the wound condition into a so-called bank wound condition that the wire W of each layer is crept between the wire W of the lower layer. In the bank wound condition, the cross section of the wire becomes a cross-stitched arrangement. As a result, the pressurized wire W is deprived an elastic force in the direction to increase the outer diameter from because the wire W is plastically deformed. Therefore, as shown in FIG. 3, a stuck condition is maintained even if compression with the chuck 4 of the pressurizing machine is released.

Figure 4:
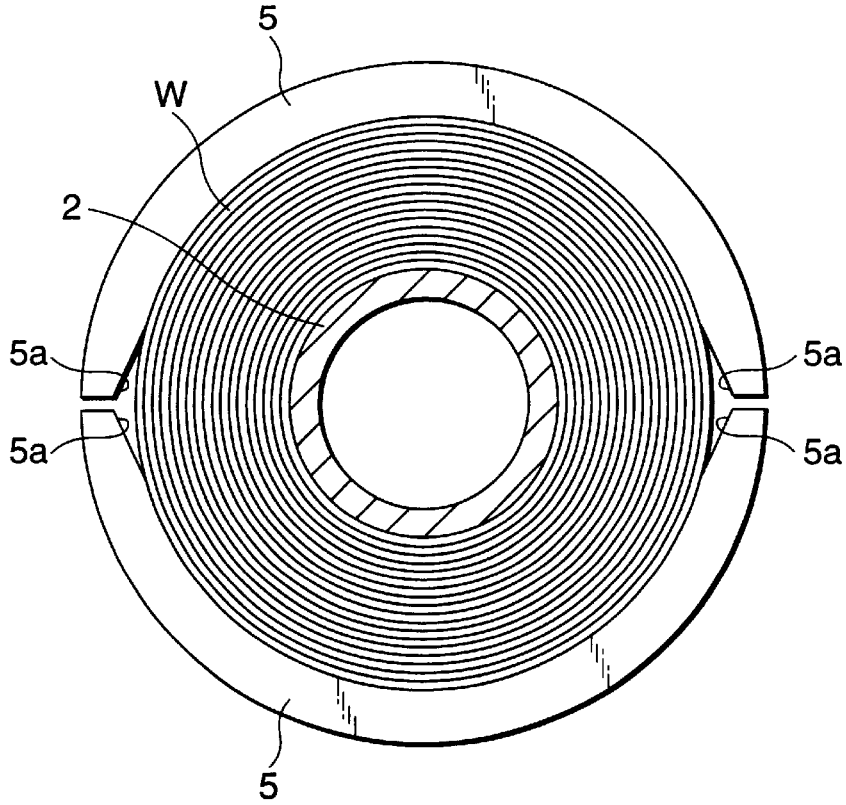
FIG. 4 is an explanatory drawing which describes a process to prevent loosening with chucks.
Figure 5:
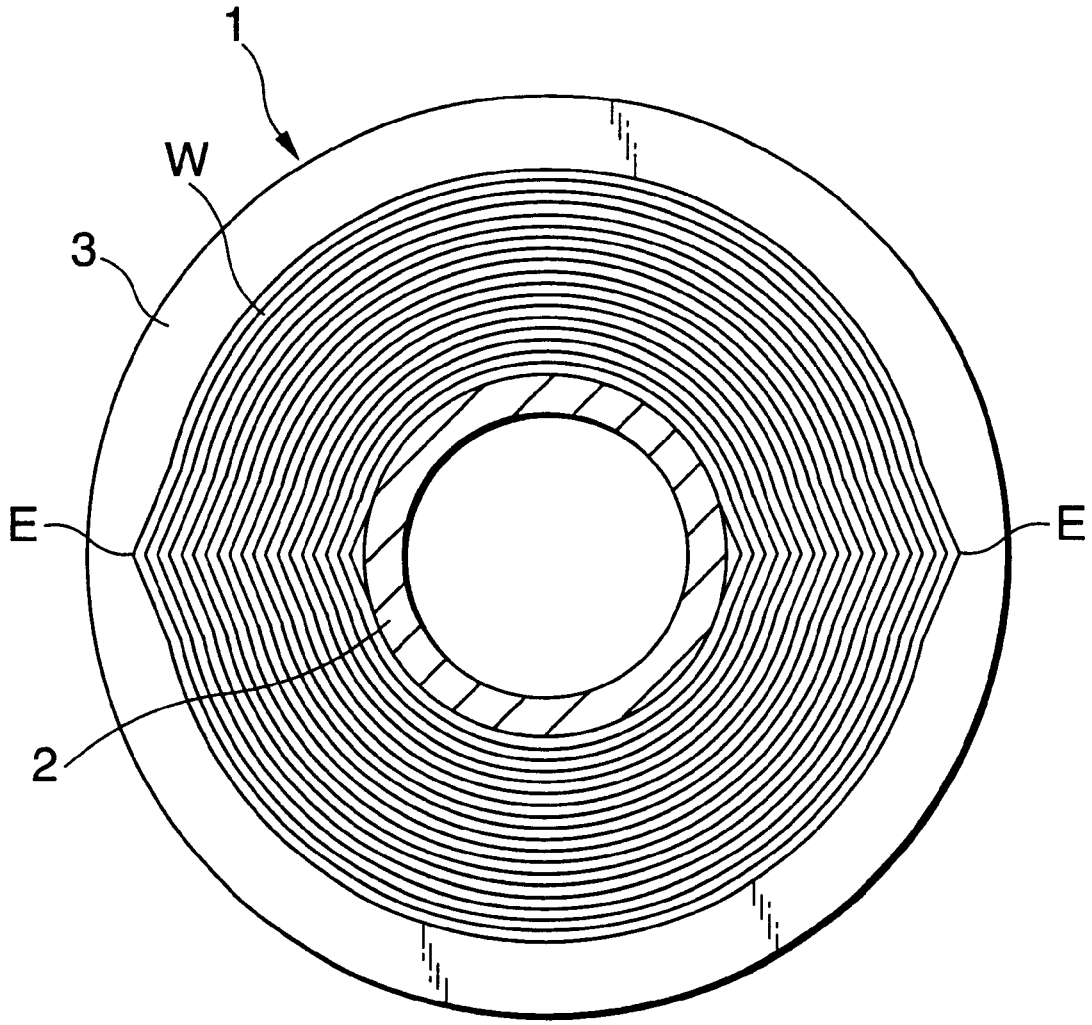
FIG. 5 is a side sectional view of a wire wound around a reel after processing a treatment to prevent loosening.

FIG. 4 describes another embodiment of a method to prevent loosening according to the present invention. In this embodiment, two-piece chucks 5 of the pressurizing machine respectively have end portions 5*a* on both ends of the internal surfaces. In the end portions 5*a*, inner radii of the chuck are slightly increased, and two escape portions are provided on both left and right portions when upper and lower chucks are coupled. With these chucks 5, when a wire wound around a reel is pressurized, the wire W of each layer is crept between the wire W of the lower layer, that is, the wound condition becomes a bank wound condition as in the condition shown in FIG. 3. Moreover, as shown in FIG. 5, obtuse angled portions E are formed at both left and right portions of the wire W in each turn. As a result, the wire W is deprived an elastic force in the direction to increase the outer diameter from. Moreover, even if angled portions E of each turn are slipped in the circumferential direction when the winding of the wire W is slightly loosened by vibration or the like, the angled portions E of each turn work as a stopper to prevent the next turns from slipping in the sideward direction. Therefore, the wound wire W is prevented from being tangled because each turn does not climb over the next turns.

In order to finish the preparation of a wire wound around a reel, a piece of plastic tape is stuck on the outer circumferential surface of the wire W, and the tip portion of the wire W is fixed. However, the wire processed with the method according to the present invention is not swelled even if the piece of tape is peeled off before use. Therefore, it is evident that a wire wound around a reel according to the present invention differs from conventional one at first glance.

Furthermore, the present invention is not limited to the above embodiment, but the invention can be changed and modified in other various manners within the technical scope of the present invention. Needless to say, such changes and modifications fall within the scope of the invention.

As described above, according to the method of the present invention to present a wire wound around a reel for fastening reinforcing bars from being loosened, the wire is deprived an elastic force in the direction to increase the outer diameter from so that the outer circumferential surface of the reel-wound wire is pressurized. As a result; winds of the wire, which may be loosened because of the "spring-back" phenomenon, is prevented from being loosened when a piece of tape stuck on the circumferential surface of the wire is peeled off. Therefore, the tip of the wire can be easily drawn, and an operation installing to the reinforcing bar fastening machine is accomplished very easily and promptly. Moreover, handling of the machine is remarkably improved because the method also prevents the wire from coming off the reel and twining around itself by accident.

The present invention is based on Japanese Patent Application No. Hei. 10-350907 which is incorporated herein by reference.

What is claimed is:

1. A method of preventing loosening of a wire around a reel for fastening reinforcing bars, said method comprising pressurizing an outer circumferential surface of the wire inwardly in the radius directions of the reel to create a condition so that elastic forces in the directions which the outer diameter of the wire is increased are deprived therefrom, and the condition of wound wire is maintained after the pressure is released.

2. The method according to claim 1, wherein pressurizing the outer circumferential surface of the wire forms at least one angled portion on the outer circumferential surface of the wire.

3. A method of winding a wire for fastening reinforcing bars, said method comprising:

winding the wire around a reel; and pressurizing an outer circumferential surface of the wire inwardly in the radius directions of the reel to create a condition so that elastic forces in the directions which the outer diameter of the wire is increased are deprived therefrom, and the condition of wire is maintained after the pressure is released.

4. The method according to claim 3, wherein pressurizing the outer circumferential surface of the wire forms at least one angled portion on the outer circumferential surface of the wire.

* * * * *